United States Patent [19]

Wintoniw

[11] 4,041,938

[45] Aug. 16, 1977

[54] MASSAGE APPARATUS

[76] Inventor: Helen Wintoniw, Box 215, Keremeos, British Columbia, Canada

[21] Appl. No.: 703,415

[22] Filed: July 8, 1976

[51] Int. Cl.[2] ..... A61H 7/00

[52] U.S. Cl. ..... 128/52; 128/55

[58] Field of Search ..... 128/52, 55, 24.2, 44, 128/60, 62, 57

[56] References Cited

U.S. PATENT DOCUMENTS

| | | | |
|---|---|---|---|
| 2,062,300 | 12/1936 | Erickson | 128/55 X |
| 2,889,826 | 6/1959 | Russo | 128/57 |
| 3,078,843 | 2/1963 | Brisson | 128/52 |
| 3,628,528 | 12/1971 | Roberts | 128/57 |
| 3,799,155 | 3/1974 | Gerlich | 128/44 |
| 3,882,856 | 5/1975 | Heuser et al. | 128/52 X |

FOREIGN PATENT DOCUMENTS

| | | | |
|---|---|---|---|
| 1,948,568 | 4/1971 | Germany | 128/52 |

*Primary Examiner*—Lawrence W. Trapp
*Attorney, Agent, or Firm*—Allen D. Brufsky

[57] ABSTRACT

Massage apparatus for simulating a hand massage by a masseuse including a bracket having a plurality of flexible massage fingers for contact with the torso. The bracket is simultaneously reciprocal in a horizontal and vertical direction and can oscillate as the fingers massage the torso.

6 Claims, 4 Drawing Figures

FIG.1
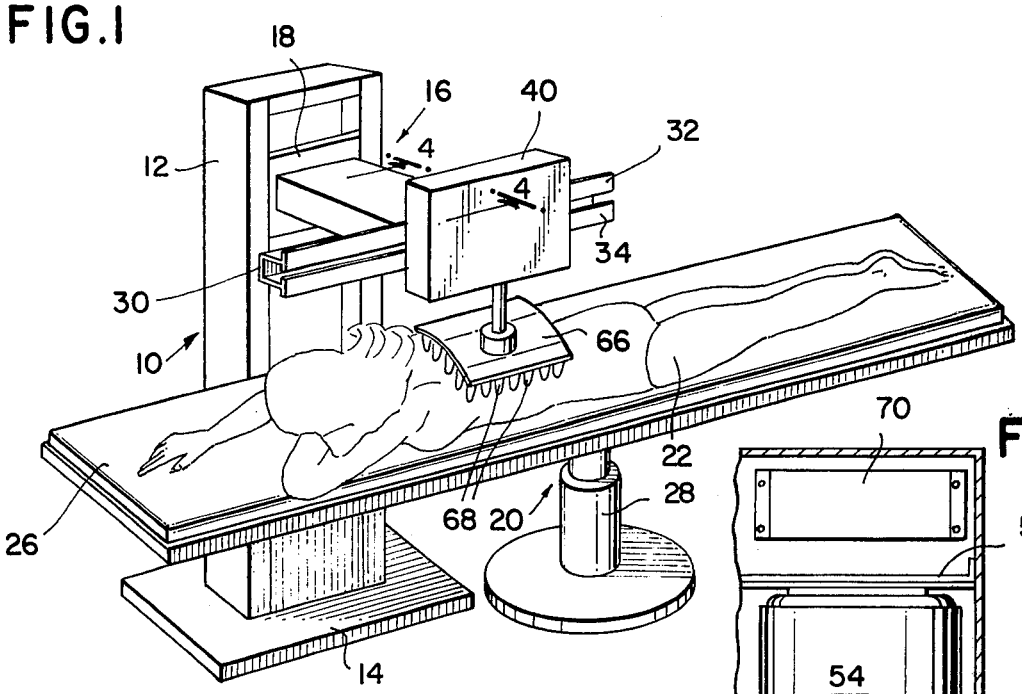
FIG.3
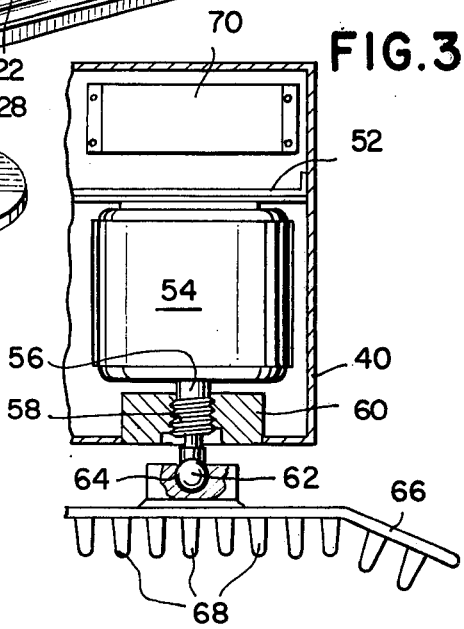
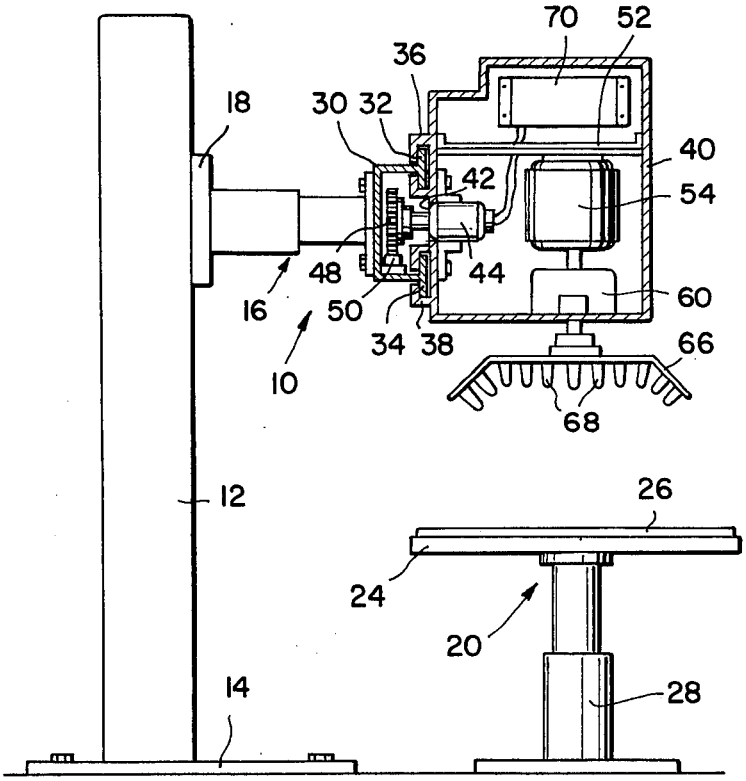
FIG.2
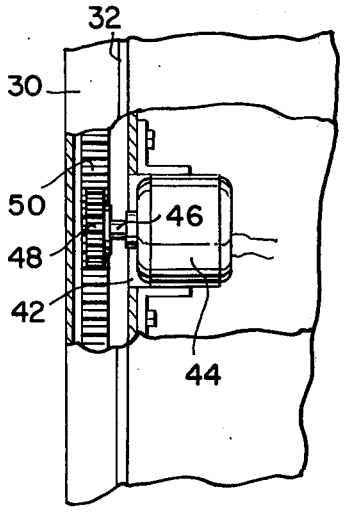
FIG.4

MASSAGE APPARATUS

BACKGROUND OF THE INVENTION

This invention relates to a massage apparatus, and more particularly, a massage apparatus for simulating a hand massage.

Various devices have been suggested for massaging the human body. Such devices are mainly of the vibrating type operating at high frequencies. This vibrating action is quite different from the hand massage as practiced by a masseuse.

SUMMARY OF THE INVENTION

Accordingly, this invention provides a massage apparatus for closely simulating a hand massage and includes a bracket mounting a plurality of rubber or flexible massaging fingers. The bracket is moved back and forth across the torso of the user by a rack and pinion drive mounted on a vertically adjustable crossbar. Simultaneously, the fingers are reciprocated vertically by a screw drive. The bracket is universally mounted on the screw drive so as to conform to the shape of the body of the user as the bracket is moved across the torso.

BRIEF DESCRIPTION OF THE DRAWING

Further objects and advantages of the invention will become apparent from the following description and claims, and from the accompanying drawing, wherein;

FIG. 1 is a perspective view of the massage apparatus of the present invention;

FIG. 2 is a side view in elevation of the apparatus of FIG. 1 as seen from the left-hand side of FIG. 1, with portions thereof in section;

FIG. 3 is an enlarged detail view of a portion of the FIG. 2; and

FIG. 4 is an enlarged cross-sectional view taken substantially along the plane indicated by line 4-4 of FIG. 1.

DETAILED DESCRIPTION OF THE PREFERRED EMBODIMENT

Referring now to the drawing in detail, wherein like numerals indicate like elements throughout the several views, the massage apparatus 10 of the present invention includes an upright support 12 mounted on a base 14. A horizontal telescoping support 16 mounted on a bracket 18 is selectively slidable to a desired elevation on upright support 12 relative to a couch 20 for supporting the torso of the user 22. Couch 20 includes a planar surface 24 mounted on a pedestal 28. A pad 26 is fixed to the top of planar surface 24.

Fixed to the end of horizontal support 16 is a horizontal, channel-shaped cross bar 30, having upper and lower end flanges 32 and 34 slidably received in channels 36 and 38 attached to a housing 40. Housing 40 has an opening 42 through which a reversible electric motor 44 mounted in housing 40 extends. The drive shaft 46 of motor 44 is connected to a pinion 48 in meshing engagement with a rack 50 fixed to the bottom of cross bar 30.

Also mounted on a slidable bracket 52 within housing 40 is a reversible electric motor 54. The drive shaft 56 of motor 54 includes a screw element 58 in threaded engagement with a fixed nut 60 mounted on the bottom of housing 40. Connected to the end of shaft 56 is a ball 62 received within a socket 64 fixed to the top of an arcuate bracket 66. Extending downwardly from the lower surface of bracket 66 are a plurality of rubber flexible fingers 68.

Fingers 68 are moved back and forth across the torso 22 of the user ot massage the torso on couch 20 by actuation of motor 44. Motor 44 will turn pinion 48 on shaft 46 so that the pinion 48 will reciprocably traverse rack 50 to slidably move housing 40 and bracket 66 along cross bar 30. The rotation of motor 44 is reversed by conventional control circuitry housed beneath cover 70 in housing 40 when pinion 48 reaches each end of rack 50. Simultaneously, the fingers 68 are reciprocated vertically relative to torso 22 by rotation of shaft 56 by motor 54, which causes screw element 58 to move linearly relative to fixed nut 60. Rotation of motor 54 is periodically reversed by conventional control circuitry housed beneath cover 70.

Because of the universal mounting of ball 62 in socket 64, the bracket 66 can also oscillate to conform to the shape of torso 22 as the bracket 66 is moved across the torso 22. The resultant motion imparted by fingers 68 to the torso simulates a hand massage by a masseuse.

It should also be understood that bracket 66 is illustrative of only one type of massage mechanism. A scalp massager or a foot massage element may be alternately mounted to ball 64.

I claim:

1. Massage apparatus comprising:

a support;

a housing mounted on said support;

means for reciprocably driving said housing in a horizontal direction relative to said support;

body massage means universally mounted on said housing; and means within said housing for reciprocably driving said body massage means in a vertical direction relative to said support.

2. Massage apparatus in accordance with claim 1, wherein said body massage means includes a bracket, and a plurality of flexible fingers connected to said bracket.

3. Massage apparatus in accordance with claim 1, wherein said means for reciprocably driving said housing includes a reversible electric motor in said housing, a pinion connected to said motor and a rack in meshing engagement with said pinion fixed to said support.

4. Massage apparatus in accordance with claim 1, wherein said means for reciprocably driving said body massage means includes a reversible electric motor in said housing; a screw connected to said motor, and a fixed nut in said housing threadedly connected to said nut.

5. Massage apparatus in accordance with claim 1, wherein said universal mounting includes a ball and socket connection between said body massage means and said housing.

6. Massage apparatus in accordance with claim 1, wherein said support includes a horizontal channel-shaped cross-bar having a pair of end flanges, said housing including a channel in sliding engagement with each of said flanges.

* * * * *